US008532557B2

(12) United States Patent
Kusumi et al.

(10) Patent No.: US 8,532,557 B2
(45) Date of Patent: Sep. 10, 2013

(54) ATTACHMENT ASSIST DEVICE AND IMAGE FORMING APPARATUS INCLUDING SAME

(75) Inventors: Tadashi Kusumi, Kawasaki (JP); Katsuhiko Miki, Tokyo (JP); Yoshikuni Ishikawa, Tokyo (JP); Hiroshi Kajiyama, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 353 days.

(21) Appl. No.: 12/805,111

(22) Filed: Jul. 13, 2010

(65) Prior Publication Data

US 2011/0013973 A1 Jan. 20, 2011

(30) Foreign Application Priority Data

Jul. 16, 2009 (JP) ..... 2009-167733
Mar. 19, 2010 (JP) ..... 2010-064242

(51) Int. Cl.
*G03G 15/00* (2006.01)

(52) U.S. Cl.
USPC ..... 399/367; 399/110; 399/377

(58) Field of Classification Search
USPC ..... 399/110, 347, 367, 377, 380; 403/52, 403/119
See application file for complete search history.

(56) References Cited

U.S. PATENT DOCUMENTS 4,494,746 A * 1/1985 Moser ..... 271/164
5,758,250 A 5/1998 Miki
5,823,525 A 10/1998 Miki
5,848,787 A 12/1998 Miki
5,943,667 A 8/1999 Aggarwal et al.
6,062,557 A 5/2000 Kusumi
7,065,318 B2 6/2006 Miki
2005/0069360 A1 3/2005 Miki
2006/0180996 A1 * 8/2006 Iwase et al. ..... 271/162
2009/0129812 A1 * 5/2009 Kawanami et al. ..... 399/111
2010/0007081 A1 1/2010 Miki

FOREIGN PATENT DOCUMENTS

CN 1765718 5/2006
JP 2004-117395 4/2004
JP 2006-151687 6/2006

(Continued)

OTHER PUBLICATIONS

Chinese Office Action dated Jul. 23, 2012 issued in Chinese Appln. No. 201010231428.9.

(Continued)

*Primary Examiner* — Walter Lindsay, Jr.
*Assistant Examiner* — Barnabas Fekete
(74) *Attorney, Agent, or Firm* — Harness, Dickey & Pierce P.L.C.

(57) ABSTRACT

An attachment assist device includes an engagement member provided in one of a main body and a retractable unit, a catch portion provided in the other of the two, to engage the engagement member when the retractable unit is positioned at a drawing start position, and a drawing unit provided in the main body, to draw the retractable unit to a drawing completion position in the main body against multiple resistive forces acting on the retractable unit. On a projection plane on which the retractable unit is projected in an attachment direction, an engagement position where the engagement member engages the catch portion is disposed inside a rectangular area defined by two opposing corners respectively positioned at points of action of two of the multiple resistive forces acting on the retractable unit while the retractable unit moves from the drawing start position to the drawing completion position.

15 Claims, 7 Drawing Sheets

(56) References Cited

FOREIGN PATENT DOCUMENTS

| | | |
|---|---|---|
| JP | 2006-176241 | 7/2006 |
| JP | 2007-070068 | 3/2007 |
| JP | 4115381 | 4/2008 |
| JP | 2008-254841 | 10/2008 |
| JP | 4435241 | 1/2010 |

OTHER PUBLICATIONS

Abstract of JP 2005-178925 published Jul. 7, 2005.
Abstract of JP 2008-195540 published Aug. 28, 2008.

* cited by examiner

ATTACHMENT ASSIST DEVICE AND IMAGE FORMING APPARATUS INCLUDING SAME

CROSS-REFERENCE TO RELATED APPLICATIONS

This patent specification is based on and claims priority from Japanese Patent Application Nos. 2009-167733, filed on Jul. 16, 2009, and 2010-064242 filed on Mar. 19, 2010 in the Japan Patent Office, the contents of which are hereby incorporated by reference herein in their entirety.

BACKGROUND OF THE INVENTION

1. Field of the Invention

The present invention generally relates to an attachment assist device to assist attachment of a retractable unit to a main body, a sheet feeder including the same, and an image forming apparatus including the same.

2. Discussion of the Background Art

In general, electrophotographic image forming apparatuses, such as copiers, printers, facsimile machines, or multifunction devices including at least two of those functions, include a reading unit to read image data of documents, an image forming unit to form images on sheets of recording media according to the image data ready by the reading unit, and a sheet feeder to feed the sheets to the image forming unit. The image forming unit includes an optical writing device to direct a writing light (i.e., a laser beam) onto a surface of an image carrier (i.e., a photoconductor), thus forming an electrostatic latent image thereon, and a development device to develop the latent image with toner. In multicolor image formation, the image forming unit forms cyan, magenta, yellow, and black toner images on a single photoconductor or respective photoconductors, which are transferred therefrom and superimposed one on another on the sheet, thus forming a multicolor image on the sheet.

Image forming apparatuses further include a sheet tray that can contain multiple sheets and be retracted into and pulled out from a main body. For example, the sheet feeder includes a pickup roller to feed the sheets contained in the sheet tray to the image forming unit sequentially from the top. When the sheet tray is empty or when users desire to change a sheet size or the like, the user pulls the sheet tray out of the main body, fills the sheet tray with sheets, and then pushes the sheet tray back into the main body.

In such image forming apparatuses, if the sheet tray is not properly positioned in the sheet feeder or main body in a direction in which the sheet tray is properly inserted into the main body (hereinafter "insertion direction"), the image forming apparatus can form a substandard image on the sheet, with the image deviating from the center of the sheet in a width direction of the sheet. However, when the sheet tray is too heavy, the user has to press the sheet tray with greater force to insert the sheet tray into the sheet feeder. Yet, if the user pushes the heavy sheet tray with excessive force, the sheet tray might hit the sheet feeder, impacting the sheet tray as well as the sheet feeder. The impact to the sheet tray can disturb the sheets stacked in the sheet tray and damage the sheet tray.

In view of the foregoing, several approaches described below have been tried to assist attachment of the sheet tray into the apparatus, in particular, insertion of the sheet tray into the main body of the apparatus.

For example, JP-2006-151687-A discloses an image forming apparatus that includes an engagement pin provided in the sheet tray, a drawing mechanism to draw the sheet tray into the main body, and a guide groove formed in the main body to guide the engagement pin, thus guiding insertion of the sheet tray into the main body. The drawing mechanism includes a toggle spring and a pivotable arm to engage the engagement pin provided in the sheet tray. Additionally, the guide groove includes a linear portion in parallel to the insertion direction of the sheet tray and a bent portion bent toward a pivot point of the pivotable arm.

With this configuration, when the pivotable arm pivots to a predetermined position with the engagement pin engaged with the pivotable arm and guided by the guide groove, the drawing mechanism pulls the sheet tray via the engagement pin with the bias force exerted by the toggle spring. Additionally, when the engagement pin is guided by the bent portion of the guide groove bent toward the pivot point of the pivotable arm, the pivotable arm can pivot easily with the bias force of the toggle spring.

Additionally, for example, JP-2007-70068-A discloses a velocity-dependent damper unit to adjust a load for decelerating movement of the sheet tray according to a velocity with which the sheet tray is drawn by the bias force of the toggle spring. Thus, fluctuations in the velocity of the movement of the sheet tray can be reduced.

Although such an arrangement has advantages, it also has several drawbacks.

For example, because the sheet tray should be pulled into the main body against various resistive forces acting on the sheet tray, using the damper unit can increase the force required for pulling out the sheet tray from the main body. Examples of such resistive forces include sliding resistance due to the weight of sheets contained in the sheet tray, frictional resistance in positioning the sheet tray, and resistance of a sheet feed mechanism being engaged or disengaged from the sheet tray.

At present, barrier-free facilities have been promoted to provide easier access for elderly people and people with disabilities, and, in December 2000, the U.S. government released Section 508 of the Rehabilitation Act, specifying standards for accessibility. More specifically, Section 508 specifies that the maximum force required to activate controls and keys operated mechanically shall be 5 lbs. (22.2 N). Therefore, the increase in the force to pull the sheet tray should be limited, and thus it is important to reduce the resistance in insertion of the sheet tray while increasing efficiency in insertion of the sheet tray.

The above-described problem is not limited to drawing the sheet tray but is also present in drawing any retractable unit, such as a duplex unit for forming images on both sides of sheets, that is closably openable relative to the main body of the image forming apparatus.

Therefore, the inventors of the present invention recognize that there is a need for an attachment assist device capable of positioning the retractable unit properly at a predetermined position in the main body as well as drawing the retractable unit into the main body efficiently.

SUMMARY OF THE INVENTION

In view of the foregoing, one illustrative embodiment of the present invention provides an attachment assist device to assist attachment of a retractable unit to a main body.

The attachment assist device includes an engagement member provided in one of the main body and the retractable unit, a catch portion provided in the other of the retractable unit and the main body, to engage the engagement member, and a drawing unit provided in the main body, connected to the retractable unit via the engagement member and the catch portion. Multiple resistive forces act on the retractable unit while the retractable unit moves from a drawing start position in an attachment direction to a drawing completion position in the main body. When the engagement member engages the catch portion, the drawing unit draws the retractable unit from the drawing start position to the drawing completion position against the multiple resistive force. The catch portion engages the engagement member when the retractable unit is set at the drawing start position. An engagement position where the engagement member engages the catch portion is disposed inside a rectangular area defined by two opposing corners respectively positioned at points of action of two of the multiple resistive forces acting on the retractable unit on a projection plane on which the retractable unit is projected in the attachment direction.

In another illustrative embodiment, the engagement position where the engagement member engages the catch portion is disposed beneath the rectangular area defined by the points of action of the two of the multiple resistive forces acting on the retractable unit on the projection plane of the retractable unit.

Yet in another illustrative embodiment, an image forming apparatus includes an image forming unit to form images on sheets of recording media, a retractable unit removably attachable to a main body of the image forming apparatus, and the attachment assist device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
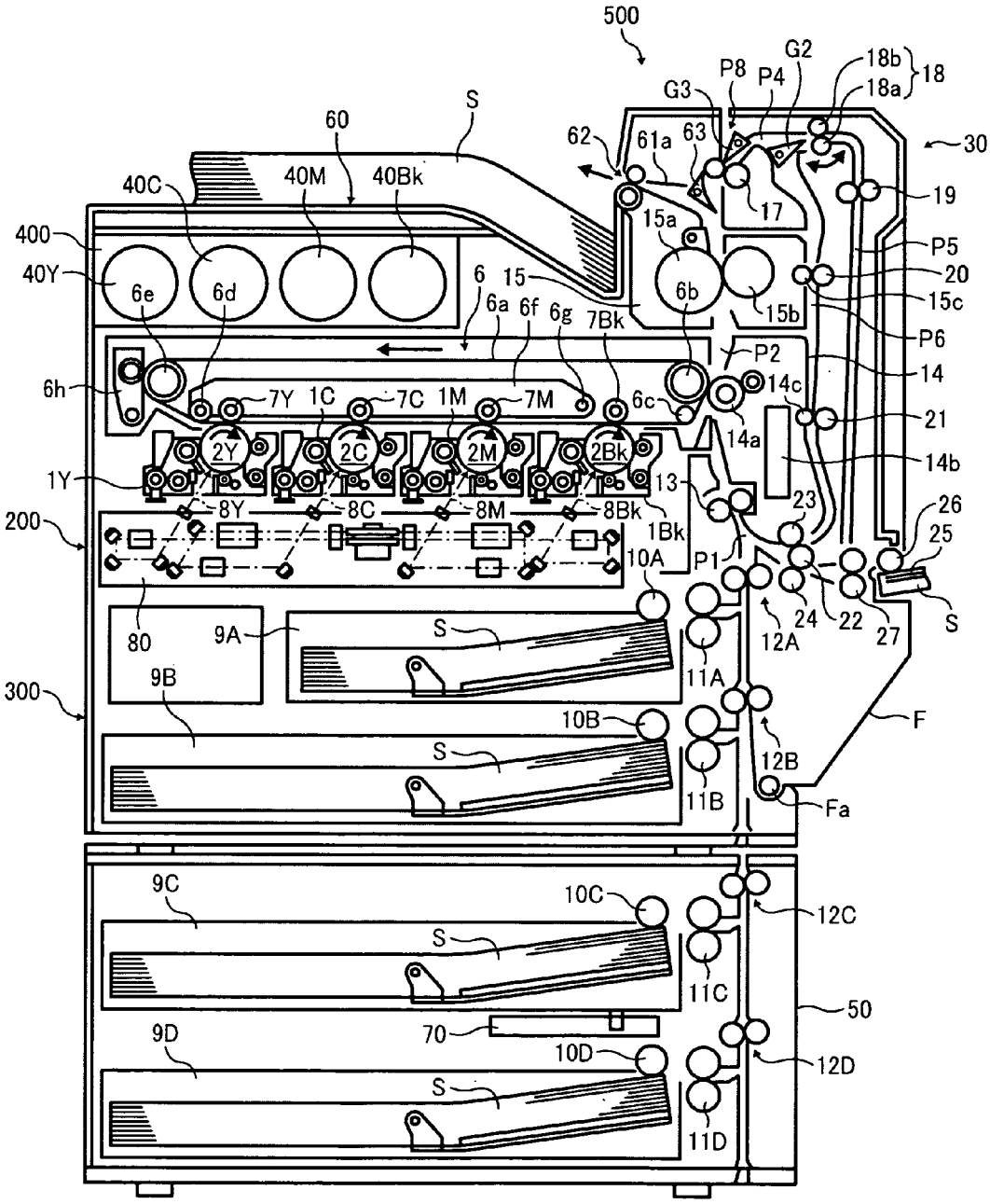
FIG. 1 is a schematic view illustrating an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described.

It is to be noted that, in the description below, reference characters Y, M, C, and BK attached to the end of each reference numeral indicate only that components indicated thereby are used for forming yellow, magenta, cyan, and black images, respectively, and hereinafter may be omitted when color discrimination is not necessary.

FIG. 1 illustrates a configuration of an image forming apparatus that in the present embodiment is a tandem-type multicolor laser printer (hereinafter simply "printer") including multiple photoconductors arranged in parallel to each other.

As shown in FIG. 1, a printer 500 includes an image forming section 200, a sheet feeder 300 to feed sheets S of recording media to the image forming section 200. The image forming section 200 includes four image forming units 1Y, 1C, 1M, and 1BK for forming yellow (Y), cyan (C), magenta (M), and black (BK) images, respectively. The image forming units 1Y, 1C, 1M, and 1BK respectively include drum-shaped photoconductors 2Y, 2M, 2C, and 2BK arranged at constant intervals in a lateral direction in FIG. 1. Each photoconductor 2 rotates clockwise in FIG. 1 as indicated by an arrow shown in FIG. 1, driven by a driving source, not shown, when the printer 500 is activated. Each image forming unit 1 further includes image forming components, such as a development device, necessary for electrophotographic image formation, provided around the photoconductor 2. The image forming units 1Y, 1C, 1M, and 1BK have similar configurations except for the color of toner used therein, and thus only the image forming unit 1Y is described in further detail below with reference to FIG. 2.

Figure 2:
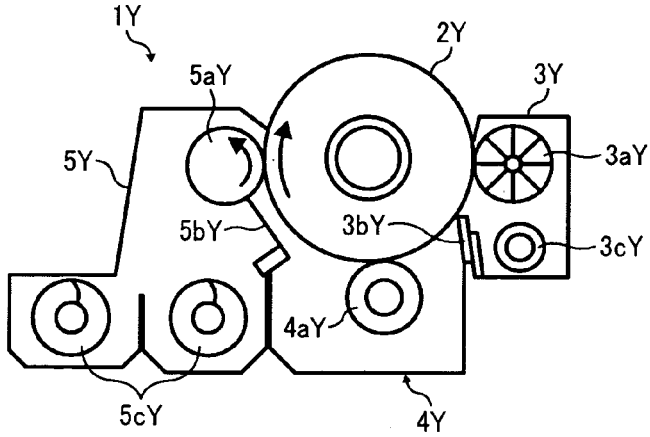
FIG. 2 is a schematic view illustrating an image forming unit for yellow included in the image forming apparatus shown in FIG. 1.

FIG. 2 is a schematic view illustrating the image forming unit 1Y for yellow included in the printer 500 shown in FIG. 1.

As shown in FIG. 2, in the yellow image forming unit 1Y, as the image forming components, a charger 4Y, a development device 5, a cleaning unit 3Y are disposed around the photoconductor 2Y clockwise in that order according to the sequence of electrostatic image forming processes. The charger 4Y includes a charging roller 4*a*Y and charges the photoconductor 2Y according to data of an image to be formed on the photoconductor 2Y. The development device 5Y includes a development roller 5*a*Y, a development blade 5*b*Y, and screws 5*c*Y and supplies toner to the charged photoconductor 2Y. The cleaning unit 3Y includes a cleaning brush 3*a*Y, a cleaning blade 3*b*Y, and a collection screw 3*c*Y and removes toner from the photoconductor 2Y.

The photoconductor 2Y includes a cylindrical aluminum base having a diameter of within a range from 30 mm to 120 mm and a photosensitive organic semiconductor layer overlying a surface of the aluminum base, for example. It is to be noted that the photoconductor 2Y is not necessarily cylindrical but can be belt-shaped.

Referring to FIG. 1, an exposure unit 80 is provided beneath the photoconductors 2. The exposure unit 80 serves as a latent image forming member and scans uniformly-charged surfaces of the respective photoconductors 2 with respective laser beams 8 according to image data of respective colors, thus forming electrostatic latent images thereon. In each image forming unit 1, a slit extending in a direction parallel to an axis of rotation of the photoconductor 2 is formed between the charger 4 and the development device 5 so that the laser beam 8 emitted from the exposure unit 80 can reach the photoconductor 2.

The exposure unit 80 shown in FIG. 1 is a laser scanning type and includes four semiconductor laser light sources, a polygon mirror, and the like although not shown in FIG. 1. The exposure unit 80 directs the laser beams 8, modulated according to the image data, emitted from the four semiconductor light sources, not shown, to the photoconductors 2, respectively. The exposure unit 80 includes a metal or resin frame housing optical components and control-related components, and a translucent dustproof member is provided on its upper surface as a light emission port. It is to be noted that, although the printer 500 shown in FIG. 1 includes a single exposure unit 80, alternatively, multiple individual exposure units may be provided for the respective image forming units 1. Additionally, the exposure unit 80 can employ known light emitting diode (LED) arrays and an imaging element in combination instead of the semiconductor laser light sources. In this case, several thousands to several tens of thousands of micromachined LED are lined, and thus optical writing is performed with the LEDs corresponding to respective dots forming the latent image on the photoconductor 2. That is, the optical system requires only a simple converging lens, eliminating the need of a mechanical driving system such as a polygon mirror, and thus reliability can be enhanced while reducing the cost as well as the size of the exposure unit 80.

Yellow, cyan, magenta, and black toners are consumed in image development performed by the respective development devices 5, and toner detectors, not shown, detect the amount or concentration of toner in the respective development devices 5. Four toner cartridges 40Y, 40C, 40M, and 40BK are provided in an upper portion of the printer 500, and the respective color toners are supplied from the toner cartridges 40Y, 40C, 40M, and 40BK by toner supply devices, not shown, to the development devices 5. An exterior of each toner cartridge 40 is formed as a container made of resin or paper, for example, and a discharge port is formed therein. Each toner cartridge 40 is configured to facilitate attachment and removal of the toner cartridge 40 from an attachment portion 400 provided in the upper portion of the printer 500. When the toner cartridge 40 is attached to the attachment portion 400, the discharge port formed in the toner cartridge 40 is connected to a toner supply member provided in a main body of the printer 500. Additionally, the printer 500 includes a preventive of errors in attachment of the toner cartridges 40 because wrong color toner is supplied to the development device 5 if the toner cartridge 40 is attached at a wrong position. For example, the toner cartridges 40 may be different in shape so that each toner cartridge 40 can match only the position of corresponding color in the attachment portion 400.

Each development device 5 includes two screws 5*c* for agitating toner and carrier and transporting developer including the toner and the carrier. When the development device 5 is installed in the printer 500, one end of the toner supply member is connected to an upper portion of the screw 5*c* on the left in FIG. 2. Referring to FIG. 2, the toner is supplied by the screws 5*c* to the development roller 5*a* rotating counterclockwise in FIG. 2, and the development blade 5*b* adjusts the thickness of a toner layer on a circumferential surface of the development roller 5*a* to a predetermined or given thickness. The development roller 5*a* includes a stainless steel or aluminum sleeve rotatably fixed to a frame (not shown) of the development device 5 so that a constant distance is maintained between the photoconductor 2 and the development roller 5*a*, and the sleeve contains magnets that form predetermined magnetic force lines. The electrostatic latent image formed on each photoconductor 2 by the corresponding laser beam 8 is developed by the development device 5 using the corresponding color toner.

Referring to FIG. 1, the printer 500 further includes an intermediate transfer unit 6 disposed above the photoconductors 2. The intermediate transfer unit 6 includes an intermediate transfer belt 6*a*, serving as an image carrier, stretched around a secondary-transfer facing roller 6*b*, rollers 6*c* and 6*d*, and a cleaning facing roller 6*e*. As the roller 6*b* rotates, driven by a driving source (not shown), the intermediate transfer belt 6*a* rotates counterclockwise in FIG. 1 as indicated by an arrow shown in FIG. 1. The intermediate transfer belt 6*a* is an endless belt and positioned so that the surface of each photoconductor 2 can contact the intermediate transfer belt 6*a* after passing an area facing the development device 5. Four primary-transfer rollers 7 are provided on an inner circumferential side of the intermediate transfer belt 6*a* at positions facing the respective photoconductors 2.

A belt cleaning unit 6*h* is provided on an outer circumferential side of the intermediate transfer belt 6*a* at a position facing the cleaning facing roller 6*e*. The belt cleaning unit 6*h* removes any toner remaining on a surface of the intermediate transfer belt 6*a*, paper dust, and the like from the intermediate transfer belt 6*a*. The cleaning facing roller 6*e* disposed facing the belt cleaning unit 6*h* is movable and includes a mechanism to press against the intermediate transfer belt 6*a* at an appropriate pressure to keep the intermediate transfer belt 6*a* taut constantly. Additionally, the belt cleaning unit 6*h* moves in conjunction with the cleaning facing roller 6*e*.

For example, the intermediate transfer belt 6*a* includes a resin film or rubber base having a thickness within a range of from 50 μm to 600 μm and has a resistivity at which the toner image formed on each photoconductor 2 can be transferred onto the surface of the intermediate transfer belt 6*a* electrostatically with a bias applied to the corresponding primary-transfer roller 7. It is to be noted that the intermediate transfer belt 6*a* and the related components are supported by a common unit casing and together form the intermediate transfer unit 6 removably attachable to the printer 500. For example, the intermediate transfer belt 6*a* may be a polyamide belt in which carbon is dispersed and have a volume resistivity within a range of about $10^6$ Ω·cm to $10^{12}$ Ω·cm. Additionally, a rib is formed in at least one end portion in a width direction of the intermediate transfer belt 6*a*, perpendicular to the direction in which the intermediate transfer belt 6*a* rotates, to inhibit the intermediate transfer belt 6*a* from moving in the width direction, thus maintaining reliable rotation of the intermediate transfer belt 6*a*.

For example, each primary-transfer roller 7 includes a metal core (metal roller) and an electrically conductive rubber material overlying the metal roller, and a driving source, not shown, applies a transfer bias to the metal roller. Examples of the electrically conductive rubber material include urethane rubber in which carbon is dispersed to adjust its volume resistivity to about $10^5$ Ω·cm. Alternatively, the primary-transfer roller 7 may be a metal roller without an electrically conductive rubber surface layer.

A secondary-transfer unit 14 including a secondary-transfer roller 14*a* is positioned on the right of the intermediate transfer unit 6 in FIG. 1, and a power source 14*b* is provided in the secondary-transfer unit 14. The secondary-transfer roller 14*a* is disposed on the outer circumferential side of the intermediate transfer belt 6*a* at a position facing, via the intermediate transfer belt 6*a*, the secondary-transfer facing roller 6*b* that supports the intermediate transfer belt 6*a*. For example, the secondary-transfer roller 14*a* includes a metal core (metal roller) and an electrically conductive rubber material overlying the metal roller, and a driving source 14*b* applies a transfer bias to the metal roller. Carbon is dispersed in the electrically conductive rubber material to adjust its volume resistivity to about $10^7$ Ω·cm. The secondary-transfer roller 14*a* contacts the intermediate transfer belt 6*a* at the position facing the secondary-transfer facing roller 6*b*, and thus a secondary-transfer nip (a secondary transfer position) is formed therebetween. In the secondary-transfer nip, which is the contact portion between the secondary-transfer roller 14*a* and the intermediate transfer belt 6*a*, the toner image formed on the intermediate transfer belt 6*a* is electrostatically transferred onto the sheet S passing therethrough by applying the transfer bias to the secondary-transfer roller 14*a*.

The sheet feeder 300 disposed beneath the exposure unit 80 includes multiple retractable sheet trays 9A and 9B that can be pulled out to a front side of the printer 500. For example, the number of the sheet trays may be two. The sheet feeder 300 further includes feed rollers 10A and 10B, two pairs of separation rollers 11A and 11B, and two pairs of conveyance rollers 12A and 12B for the sheet trays 9A and 9B, respectively. The sheets S contained in the sheet trays 9A and 9B are selectively sent out as the corresponding one of the feed rollers 10A and 10B rotates. Subsequently, the corresponding one of the pairs of separation rollers 11A and 11B separates the sheets S one by one by, and then the corresponding one of the pairs of conveyance rollers 12A and 12B feeds the sheet S to a feed path P1.

A pair of registration rollers 13 is provided along the feed path P1 to adjust a timing at which the sheet S is sent to the secondary-transfer nip.

The printer 500 further includes a manual bypass tray 25, a feed roller 26, a pair of reverse rollers 27 serving as a separator, a reverse roller 22, and a roller 24 disposed facing the reverse roller 22. When not used, the manual bypass tray 25 can be housed in a side frame F that is a part of the main body of the printer 500 and disposed on a side. The sheet S placed on the top on the manual bypass tray 25 is fed by the feed roller 26 to the pair of reverse rollers 27, which separates the top sheet S from the rest, and then the reverse roller 22 and the roller 24 transport the sheet S through the feed path P1 to the pair of registration rollers 13.

A fixing device 15 including a heater is provided above the secondary-transfer nip in FIG. 1. The fixing device 15 includes a fixing roller 15*a* containing the heater and a pressure roller 15*b* pressing against the fixing roller 15*a*. It is to be noted that, alternatively, a fixing device using a belt or employing an induction heating (IH) mechanism may be used. When a pivotable switchable guide 63 is at the position shown in FIG. 1, the sheet S on which the toner image is fixed is guided by a guide member 61*a* forming a discharge path and then discharged by a pair of discharge rollers 62 in a direction indicated by arrow D shown in FIG. 1 onto a discharge tray 60 formed on an upper side of the printer 500.

The printer 500 further includes a duplex unit 30 including sheet paths and rollers to reverse the sheet S and feed sheet S again to the secondary-transfer nip for forming image on both sides of the sheet in duplex printing.

More specifically, the duplex unit 30 is housed in the side frame F and includes a switchback path P5, a resupply path P6, the switchable guide 63, a second switchable guide G2, and a third switchable guide G3 to transport the sheet S to the feed path P1 after the toner image is formed on a first surface (e.g., a front side) of the sheet S. The side frame F further contains reverse rollers 18*a* and 18*b* and the reverse roller 22 connected to a driving source, not shown, that can be rotated in reverse by controlling the driving source. The reverse rollers 18*a* and 18*b* face each other and hereinafter also referred to as a pair of reverse rollers 18. The reverse roller 22 is in contact with the rollers 23 and 24, and, when the reverse roller 22 rotates clockwise in FIG. 1, the reverse roller 22 and the roller 24 rotating in combination send out the sheet S from the manual bypass tray 25. Further, when the reverse roller 22 rotates counterclockwise in FIG. 1, the reverse roller 22 and the roller 23 rotating in combination transport the sheet S through the resupply path P6 again toward the pair of registration rollers 13.

When the switchable guide 63 pivots clockwise from the position shown in FIG. 1, the sheet S on which the toner image is fixed is guided by a pair of rollers 17 to a reverse path P4, guided by the second switchable guide G2 to the pair of reverse rollers 18, and then transported to the switchback path P5. After the sheet S is forwarded to the switchback path P5, the reverse roller 18*a* as well as the second switchable guide G2 rotate counterclockwise in FIG. 1, thereby transporting the sheet S from the switchback path P5 to the resupply path P6. Subsequently, a pair of rollers 15*c* and 20 and a pair of rollers 14*c* and 21 transport the sheet S through the resupply path P6, after which the reverse roller 22 and the roller 23 transport the sheet S to the pair of registration rollers 13.

The printer 500 further includes a sheet feeder 50 disposed beneath the sheet feeder 300 as an additional sheet feed unit. The sheet trays 9C and 9D are respectively provided with feed rollers 10C and 10D, and the sheet feeder 50 further includes separation rollers 11C and 11D for the sheet trays 9A and 9B and two pairs of conveyance rollers 12C and 12C. Although the sheet feeder 50 shown in FIG. 1 includes two sheet trays 9C and 9D, the total sheet containing capacity of the sheet feeder 50 may be increased by increasing the number of sheet trays or the capacity of each sheet tray.

In the printer 500, when the third switchable guide G3, positioned above the fixing device 15 and downstream from the pair of rollers 17 in a direction in which the sheet S is transported (hereinafter "sheet conveyance direction), pivots counterclockwise from the position shown in FIG. 1, the sheet S on which the toner image is fixed is guided to a discharge path P8, and thus the sheet S can be discharged to a discharge unit (not shown) or a post-processing apparatus. Examples of the discharge unit include bin trays including multiple discharge trays arranged vertically. It is to be noted that, in FIG. 1, reference characters Fa and 70 represent an attachment assist device and a shaft with which the side frame F is hinged to the main body of the printer 500.

Next, operations performed in single-sided printing are described below with reference to FIGS. 1 and 2.

The exposure unit 80 directs the laser beam 8Y emitted from the semiconductor laser source (not shown) according to image data of yellow onto the surface of the photoconductor 2Y charged uniformly by the charging roller 4*a*Y, thus forming an electrostatic latent image on the photoconductor 2Y. Then, the development roller 5*a*Y supplies toner to the latent image, thereby developing it into a visible yellow toner image. Subsequently, the primary-transfer roller 7Y primarily transfers the yellow toner image onto the surface of the intermediate transfer belt 6*a* rotating in synchronization with the photoconductor 2Y. The above-described latent image formation, image development, and primary transfer of the image are also performed on the photoconductors 2C, 2M, and 2BK sequentially.

Consequently, the yellow, cyan, magenta, and black toner images are superimposed one on another on the intermediate transfer belt 6*a*, forming a four-color toner image, and the intermediate transfer belt 6*a* transports the four-color image in the direction (counterclockwise) indicated by the arrow shown in FIG. 1. Meanwhile, the cleaning unit 3 removes any remaining toner, paper dust, and the like, from the photoconductor 2 that has passed the position where the primary-transfer roller 7 faces the photoconductor 2 via the intermediate transfer belt 6*a*.

The four-color toner image formed on the intermediate transfer belt 6*a* is transferred by the secondary-transfer roller 14*a* onto the sheet S transported in synchronization with the intermediate transfer belt 6*a*. Subsequently, the belt cleaning unit 6*h* cleans the surface of the intermediate transfer belt 6*a* in preparation for subsequent image formation and image transfer.

Then, the sheet S is transported through a post-transfer path P2 to the fixing device 15, which fixes the toner image on the sheet S, and then the discharge rollers 62 discharge the sheet S onto the discharge tray 60 with the image surface faced down.

Next, operations performed in duplex printing are described below with reference to FIGS. 1 and 2.

After a first toner image is transferred onto the first surface of the sheet S in the above-described transfer process, the sheet S passes through the fixing device 15 and then is guided to the pair of rollers 17 by the switchable guide 63. Then, the sheet S is transported through the reverse path P4, guided by the third guide G3 disposed downstream from the pair of rollers 17 in the sheet conveyance direction, to the position above the second switchable guide G2 at the position shown in FIG. 1 and then further transported to the switchback path P5 by the pair of reverse rollers 18. At that time, the reverse roller 18*a* rotates clockwise in FIG. 1. A pair of rollers 19 rotatable in both normal and reverse directions is provided in the switchback path P5. The pair of rollers 19 rotates in the normal direction until the sheet S enters fully in the switchback path P5 and then rotates in reverse, thus reversing the sheet S. When the pair of rollers 19 and the pair of reverse rollers 18 rotate in reverse, the second switchable guide G2 pivots counterclockwise from the position shown in FIG. 1. With an end of the sheet S that is on the trailing side before the sheet S enters the switchback path P5 now forming a leading end, the sheet S is transported through the resupply path P6 by the rollers 15*c*, 20, 14*c*, and 21 to the feed path P1. Thus, the sheet S reaches the pair of registration rollers 13. Subsequently, the pair of registration rollers 13 transports the sheet P with its first surface carrying the first toner image to the secondary-transfer nip where the secondary-transfer roller 14*a* faces the intermediate transfer belt 6*a*, timed to coincide with image formation, and thus a second toner image formed on the intermediate transfer belt 6*a* is transferred onto a second surface (e.g., back side) of the sheet S.

When the sheet S reaches a predetermined position, formation of respective single-color toner images constituting the second toner image transferred onto the second surface of the sheet S are sequentially started. The second four-color toner image is formed in image forming processes similar to those in single-sided printing and then transferred onto the intermediate transfer belt 6*a*. It is to be noted that the sheet S is turned upside down at that time, and accordingly emission of laser beams 8 from the exposure unit 80 is controlled so that the latent images are formed from the opposite side in the sheet conveyance direction relative to those of the first toner image.

Then, the fixing device 15 fixes the second toner image on the sheet S, and then the discharge rollers 62 discharge the sheet S carrying the images on both sides thereof onto the discharge tray 60.

It is to be noted that, in the printer 500, sheet conveyance is controlled so that multiple sheets S can be transported through the sheet conveyance paths simultaneously to reduce time required for duplex printing. Additionally, a controller, not shown, of the printer 500 controls timings of formation of images formed on both sides of the sheet S.

Additionally, the polarity of toner images formed on the photoconductors 2 is negative, and thus the primary-transfer rollers 7 are given positive electrical charges so that the toner images can be transferred from the respective photoconductors 2 onto the intermediate transfer belt 6*a*. Similarly, the secondary-transfer roller 14*a* is given positive electrical charges so that the toner image can be transferred from the intermediate transfer belt 6*a* onto the sheet S.

It is to be noted that, although the description above concerns a configuration in which multicolor image formation is performed in both single-sided printing and duplex printing, the photoconductors 2Y, 2M, and 2C for yellow, magenta, and cyan, respectively, are not used in monochrome printing using only black toner. Therefore, in monochrome printing using only black toner, the photoconductors 2Y, 2M, and 2C are not activated. Further, the printer 500 includes a disengagement mechanism to disengage the photoconductors 2Y, 2M, and 2C from the intermediate transfer belt 6*a*. More specifically, in the printer 500, an inner frame 6*f* supporting the roller 6*d* and the primary-transfer rollers 7 is pivotable around a frame shaft 6*g*. In monochrome printing, the inner frame 6*f* is pivoted away from the photoconductors 2Y, 2M, and 2C (in FIG. 1, clockwise) with only the photoconductor 2BK in contact with the intermediate transfer belt 6*a*, and black image formation is performed in this state. Thus, operational lives of the image forming units 1Y, 1M, and 1C can be extended by disengaging the photoconductors 2Y, 2M, and 2C from the intermediate transfer belt 6*a* as well as inactivating the photoconductors 2Y, 2M, and 2C and the development devices 5Y, 5M, and 5C in monochrome printing.

An outer cover, not shown, of the printer 500 is openably closable for maintenance such as replacement of components. The components (image forming components) of each image forming unit 1 shown in FIG. 2 are held in a common unit casing, that is, the image forming unit 1 is configured as a removably insertable or retractable process cartridge into the printer 500. Thus, the components of the image forming unit 1 can be replaced at once by replacing the process cartridge, and thus handling of the components in maintenance can be easier.

Additionally, when each image forming unit 1 is configured as a process cartridge, insertion and removal of the process cartridge can be facilitate by providing a guide or handle in the process cartridge. Further, providing the process cartridge with a storage device, such as an integrated circuit (IC) tag, storing characteristics and operational conditions of the process cartridge can facilitate management of the process cartridge.

Additionally, when the intermediate transfer unit 6 is removable form the printer 500 with the intermediate transfer belt 6*a* disengaged from the photoconductors 2, handling of the intermediate transfer unit 6 in maintenance work can be easier.

Figure 3:
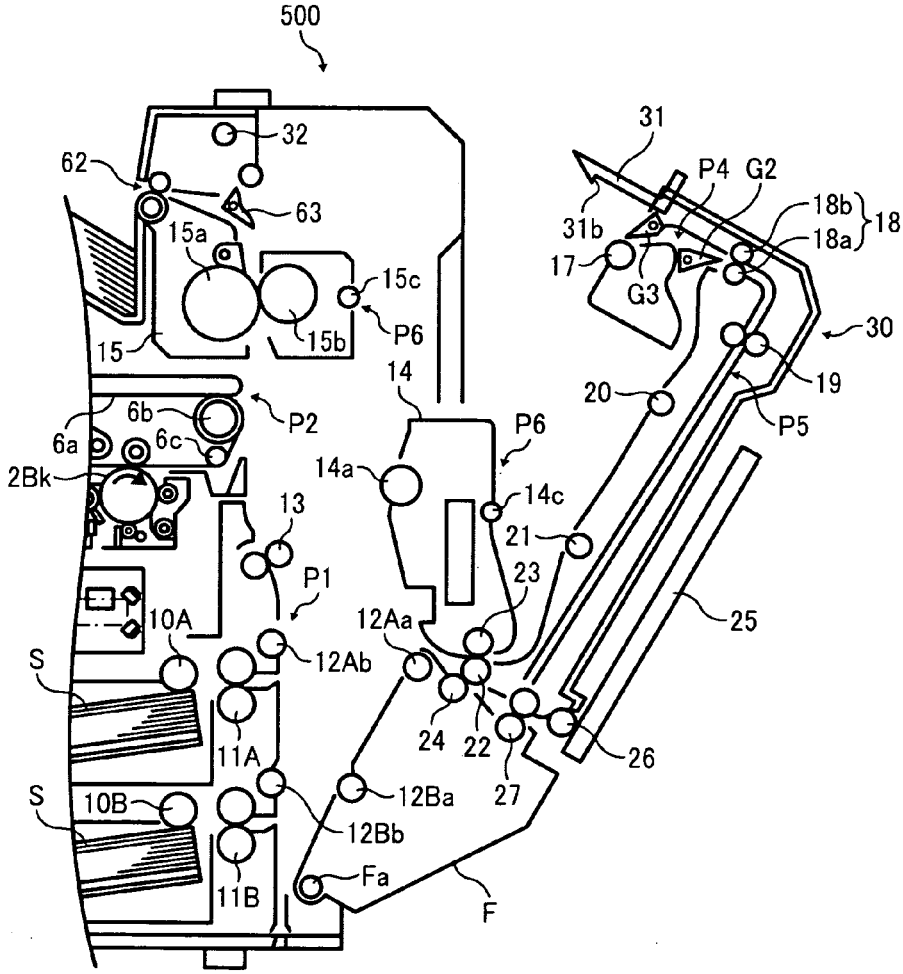
FIG. 3 illustrates a configuration around a side frame of the image forming apparatus when the side frame is opened with respect to the image forming apparatus shown in FIG. 1.

FIG. 3 illustrates a configuration around the side frame F when the side frame F is opened with respect to the printer 500.

It is to be noted that, in FIG. 3, reference characters 12Aa and 12Ab respectively represent the rollers 12A on the side of the main body (hereinafter "main body side") and the side of the side frame F (hereinafter "side-frame side"), and reference characters 12Ba and 12Bb respectively represent the rollers 12B on the main body side and the side-frame side.

Referring to FIG. 3, the side frame F is pivotable around the shaft Fa with respect to the printer 500, and the duplex unit 30 and the secondary-transfer unit 14 are housed in the side frame F. When the side frame F is pivoted clockwise from the position shown in FIG. 1, the secondary-transfer unit 14 and an interior of the duplex unit 30 are exposed as shown in FIG. 3. The side frame F further includes a stopper 31, and, when users operate a lock lever (not shown), the stopper 31 is disengaged from an engagement member 32 provided in the main body of the printer 500, thus pivoting the side frame F. With this configuration, the multiple sheet paths, that is, the feed path P1, the post-transfer path P2, and the resupply path P6, can be exposed by pivoting the side frame F, thus facilitating removal of sheets from these sheet paths when the sheets jammed therein.

The secondary-transfer unit 14 is positioned between the post-transfer path P2 and the switchback path P5 and rotatable around the roller 23. When the side frame F is opened with respect to the main body of the printer 500 as shown in FIG. 3, the secondary-transfer roller 14*a* is disengaged from the intermediate transfer belt 6*a*. Additionally, the secondary transfer unit 14 is given rotational behavior to disengage the roller 14*c* from the roller 21. The exterior of the secondary-transfer unit 14 includes the secondary-transfer roller 14*a* and the rollers 14*c* and 23, and thus the secondary-transfer unit 14 has a function to transport the sheet S.

The fixing device 15 includes the roller 15*c* for transporting the sheet S and a guide surface for guiding the sheet S, and a right side surface of the fixing device 15 in FIG. 3 forms the resupply path P6. The fixing device 15 is supported by a housing of the printer 500 so that the fixing device 15 can be pulled out to the right in the state shown in FIG. 3. This configuration facilitates removal of sheets when the sheets jammed inside the fixing device 15.

The roller 15*c* for transporting the sheet S is urged toward the roller 20 by a spring, not shown, and the roller 14*c* is urged toward the roller 21 by a spring, not shown. Additionally, the rollers 12Ab and 12Bb on the main body side are urged to the rollers 12Aa and 12Ba on the side-frame side by springs (not shown), respectively.

With this configuration, the rollers 14*c*, 15*c*, 12Ab, and 12Bb biased by the respective springs (not shown) urge the side frame F at the position shown in FIG. 1 (e.g., closed position) in a direction in which the side frame F pivots down in FIG. 1 and thus opens with respect to the main body of the printer 500. Consequently, a stopper surface 31*b* of the stopper 31 is in contact with the engagement member 32, thus setting the side frame F in position. In other words, the rollers 14*c*, 15*c*, 12Ab, and 12Bb on the main body side together form a bias unit when the side frame F is set in position relative to the main body of the printer 500 with the stopper 31 on the side-frame side and the engagement member 32 on the main body side.

Next, a configuration of the sheet tray 9C among the sheet trays 9A, 9B, 9C, and 9D is described below with reference to FIG. 4. It is to be noted that the sheet trays 9A, 9B, and 9D have configurations similar to that of the sheet tray 9C, and thus descriptions thereof are omitted.

Figure 4:
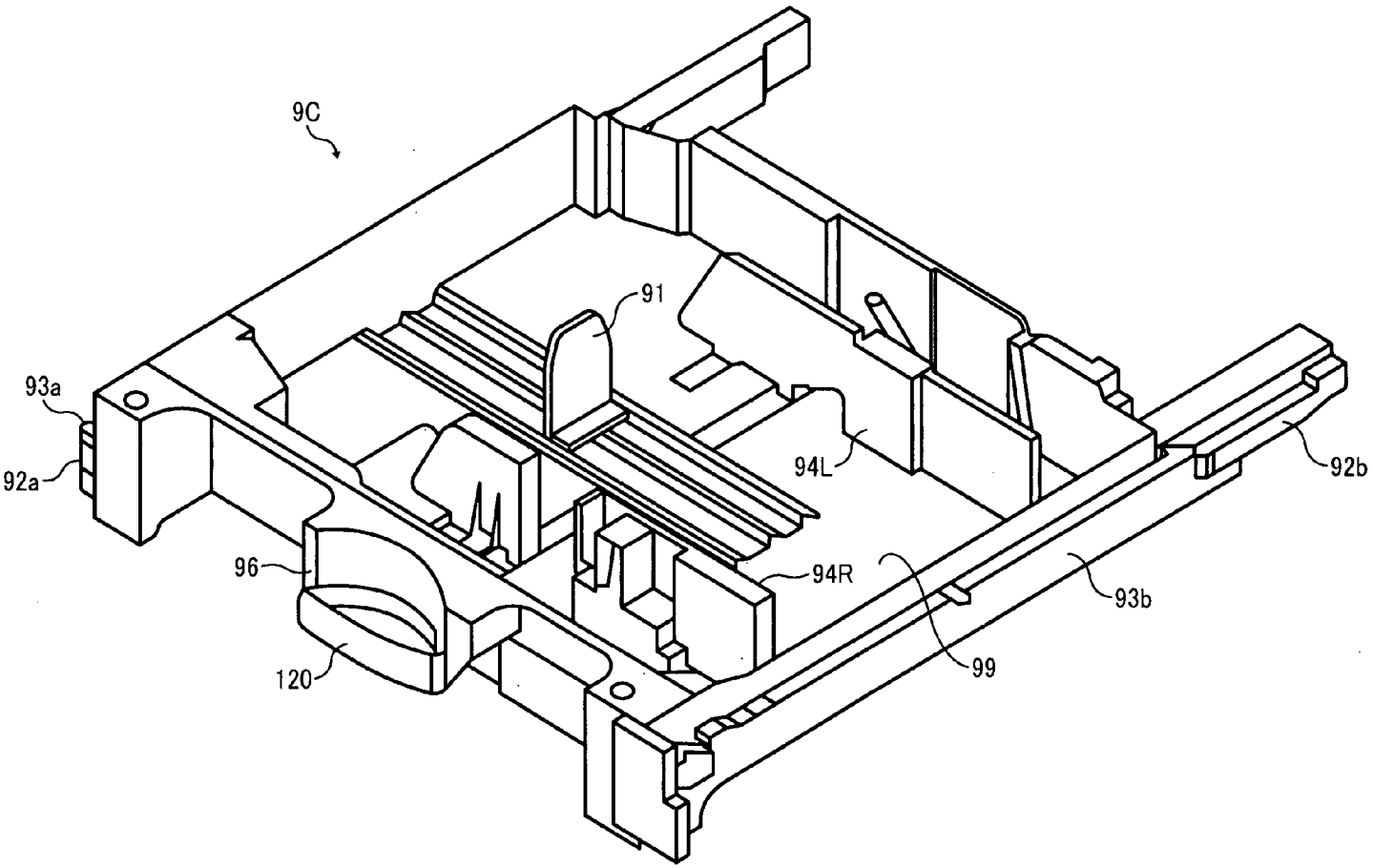
FIG. 4 is a perspective view illustrating a configuration of a sheet tray included in the image forming apparatus shown in FIG. 1.

FIG. 4 is a perspective view illustrating the sheet tray 9C.

As shown in FIG. 4, projections 92*a* and 92*b* are respectively provided on both sides of the sheet tray 9C. The sheet feeder 50 (shown in FIG. 1) serving as a main body includes guide rails 93*a* and 93*b* that support the projections 92*a* and 92*b*, respectively. With the projections 92*a* and 92*b* supported by the guide rails 93*a* and 93*b*, respectively, the sheet tray 9C can be pulled out from the sheet feeder 50 to the front side (front side of the printer 500) in a direction (e.g., sheet width direction) perpendicular to the sheet conveyance direction and inserted in the sheet feeder 50 slidingly. The sheet trays 9A, 9B, and 9D having the similar configuration to that of the sheet tray 9C are configured as removably insertable or retractable units to the sheet feeder 300 or 50 serving as a main body.

The sheet tray 9C includes a bottom plate 99 swingable upward to lift the sheets S contained in the sheet tray 9C, an end fence 91 to guide trailing end portions of the sheets S, a pair of side guides 94L and 94R to guide the sheets S on both sides in the sheet width direction.

The sheet tray 9C further includes a handle supporter 96 disposed in a center portion on the front side of the sheet tray 9C, and a handle 120 is attached to the handle supporter 96. The handle 120 supported by the handle supporter 96 is movable in a direction of insertion and removal of the sheet tray 9C, whereas the handle supporter 96 limits movement of the handle 120 in the width direction as well as an upward direction.

Figure 5A:
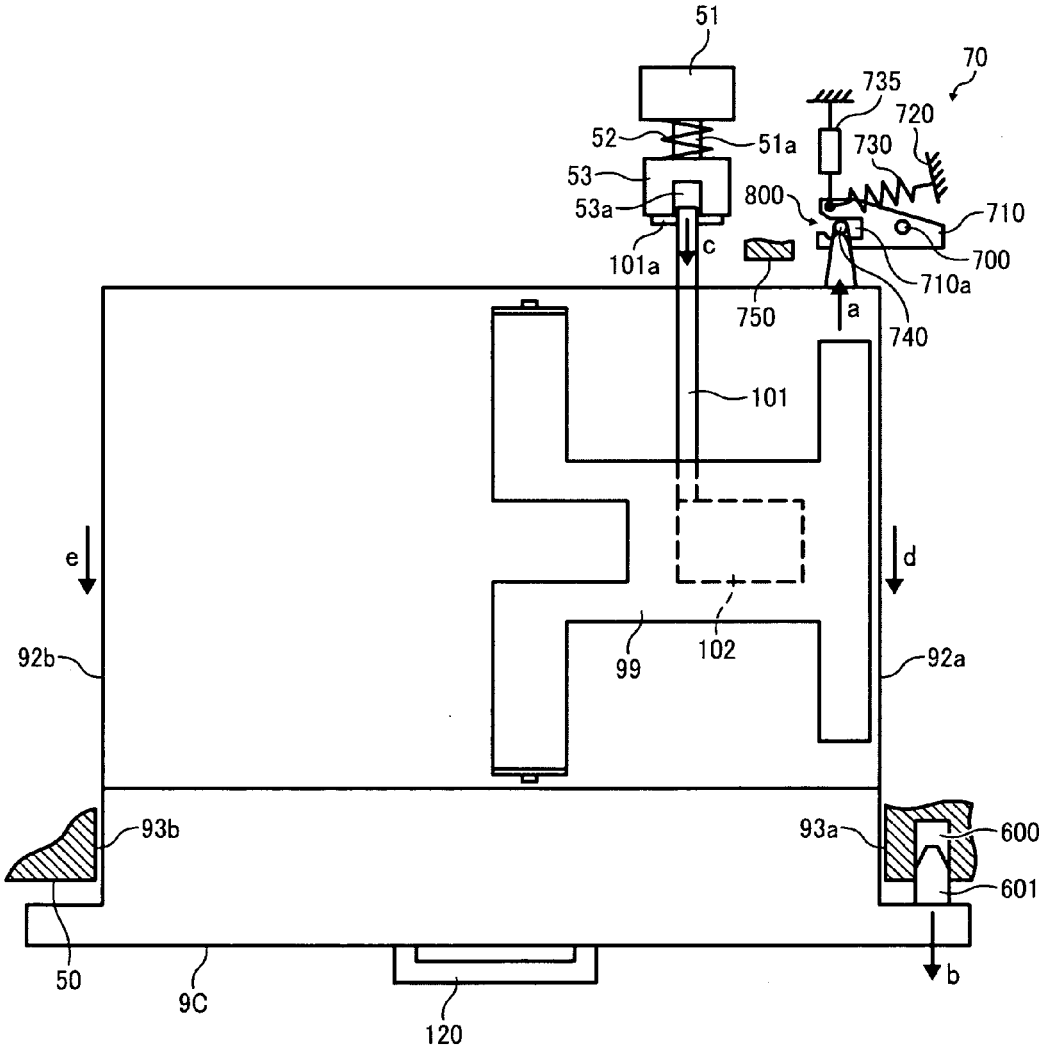
FIG. 5A is a top view illustrating the sheet tray attached to a sheet feeder.

FIG. 5A is a top view illustrating the sheet tray 9C attached to the sheet feeder 50.

Referring to FIG. 5A, the sheet feeder 50 further includes the attachment assist device 70 to pull the sheet tray 9C attached to the sheet feeder 50 in the direction of insertion of the sheet tray 9C (hereinafter "insertion direction" or "attachment direction") to a predetermined position at which the sheet tray 9C presses against a contact member 750. Thus, the position of the sheet tray 9C is defined in an anteroposterior direction, that is, the direction of insertion and removal of the sheet tray 9C and the sheet tray 9C is kept in the sheet tray 9C.

When the handle 120 of the sheet tray 9C attached to sheet feeder 50 is pulled to the front side of the sheet feeder 50, the sheet tray 9C moves to the front side and then is pulled out from the sheet feeder 50.

As shown in FIG. 5A, the sheet feeder 50 further includes an elevation motor 51, a spring 52 winding around an output shaft 51*a* of the elevation motor 51, and a coupling 53 to transmit a driving force of the motor 50 to the sheet tray 9C. The spring 52 presses the coupling 53 toward the sheet tray 9C.

The output shaft 51*a* of the elevation motor 51 is movable in an axial direction thereof, and thus the coupling 53 attached to an edge of the output shaft 51*a* is movable in the direction of removal of the sheet tray 9C (hereinafter "removal direction").

Corresponding to this configuration, a rotary shaft 101 is provided in the sheet tray 9C, and an engagement projection 101*a* is provided at a back end (in FIG. 5A, an upper end) of the rotary shaft 101 to engage the coupling 53.

The sheet tray 9C further includes a pressing member 102 that is fixed to the other end (in FIG. 5A, a lower end) of the rotary shaft 101 and lifts the bottom plate 99 to press the sheet S against the feed roller 10C depicted in FIG. 1 so that the feed roller 10C can draw the sheet S out from the sheet tray 9C.

When the sheet tray 9C is attached to the sheet feeder 50, the engagement projection 101*a* of the rotary shaft 101 presses the coupling 53 in the axial direction of the output shaft 51*a* (insertion direction). As the elevation motor 51 rotates, an engagement groove 53*a* of the coupling 53 is aligned with the engagement projection 101*a* of the rotary shaft 101, and then the spring 52 presses the coupling 53, thus engaging the engagement groove 53*a* of the coupling 53 with the engagement projection 101*a* of the rotary shaft 101. As a result, the driving force is transmitted through the coupling 53 to the rotary shaft 101.

Additionally, a positioning hole 600 is formed in the sheet feeder 50, and the sheet tray 9C further includes a positioning boss 601. When the sheet tray 9C is inserted into the sheet feeder 50, the positioning boss 601 engages the positioning hole 600, thereby defining the position of the sheet tray 9C relative to the sheet feeder 50.

In the above-described configuration, when attached to the sheet feeder 50, the sheet tray 9C receives resistive forces b, c, d, and e. The resistive force c is a reactive force of the spring 52 pressed by the coupling 53. The resistive force b is caused by friction between the positioning hole 600 and the positioning boss 601. Moreover, the resistive forces d and e are caused by sliding contact between the projections 92*a* and 92*b* of the sheet tray 9C and the guide rails 93*a* and 93*b* of the sheet feeder 50, respectively, when the sheet tray 9*c* is inserted into the sheet feeder 50.

The sheet feeder 50 includes the attachment assist device 70 to pull the sheet tray 9C against the resistive forces b, c, d, and e to a predetermined position (e.g., an insertion completion position) at which the sheet tray 9C is fully inserted into the sheet feeder 50. In the configuration shown in FIG. 5A, the attachment assist device 70 is disposed on the back of the sheet tray 9C attached to the sheet feeder 50.

In the present embodiment, the attachment assist device 70 includes a drawing arm 710 pivotably supported by a fixed shaft 700 and a toggle spring 730 serving as an elastic drawing member. The drawing arm 710 and the toggle spring 730 together form a toggle mechanism. A first end of the toggle spring 730 is fixed to a fixed portion 720 and a second end of the toggle spring 730 is connected to the drawing arm 710.

It is to be noted that, the fixed shaft 700, the drawing arm 710, the fixed portion 720, and the toggle spring 730 are provided in the sheet feeder 50 serving as the main device.

The attachment assist device 70 further includes an engagement pin 740 positioned in the sheet tray 9C, serving as an engagement member to engage the drawing arm 710. The engagement pin 740 engages a catch groove 710*a*, serving as a catch portion, provided in an edge portion of the drawing arm 710. In the configuration shown in FIG. 5A, the engagement pin 740 projects from the back side of the sheet tray 9C to engage the drawing arm 710 disposed on the back of the sheet tray 9C when the sheet tray 9C is attached to the sheet feeder 50.

It is to be noted that a reference number 800 shown in FIG. 5 represents an engagement position where the engagement pin 740 of the sheet tray 9C enagages the drawing arm 710 of the sheet feeder 50 or the engagement state between the engagement pin 740 and the drawing arm 710.

With this configuration, when the sheet tray 9C is inserted into the sheet feeder 50, the engagement pin 740, serving as the engagement member, provided in the sheet tray 9C is pressed in the catch groove 710*a*, serving as the catch portion, formed in the edge portion of the drawing arm 710, and then the drawing arm 710 pivots. At that time, the toggle spring 730 causes rotational moment acting on the drawing arm 710.

Therefore, the engagement pin 740 of the sheet tray 9C caught in the catch groove 710*a* formed in the edge portion of the drawing arm 710 is pulled with a drawing force a in the insertion direction, which is an upward direction in FIG. 5A, and then is pressed against the contact member 750. Thus, the position of the sheet tray 9C is defined in the anteroposterior direction, which a vertical direction in FIG. 5A.

The attachment assist device 70 further includes a velocity-dependent damper 735 to cause the drawing arm 710 to rotate slowly. The velocity-dependent damper 735 includes a first end fixed to a fixed portion and a second end connected to the second end of the toggle spring 730. The velocity-dependent damper 735 has a typical configuration and contains a fluid. When the drawing arm 710 draws the sheet tray 9C rapidly, the velocity-dependent damper 735 decelerates rotation of the drawing arm 710 because the resistance of the fluid increases. The force required to pull out the sheet tray 9C can be reduced when the velocity-dependent damper 735 is a unidirectional damper that does not exert attenuation in the direction in which the sheet tray 9C is pulled out from the sheet feeder 50.

Figure 5B:
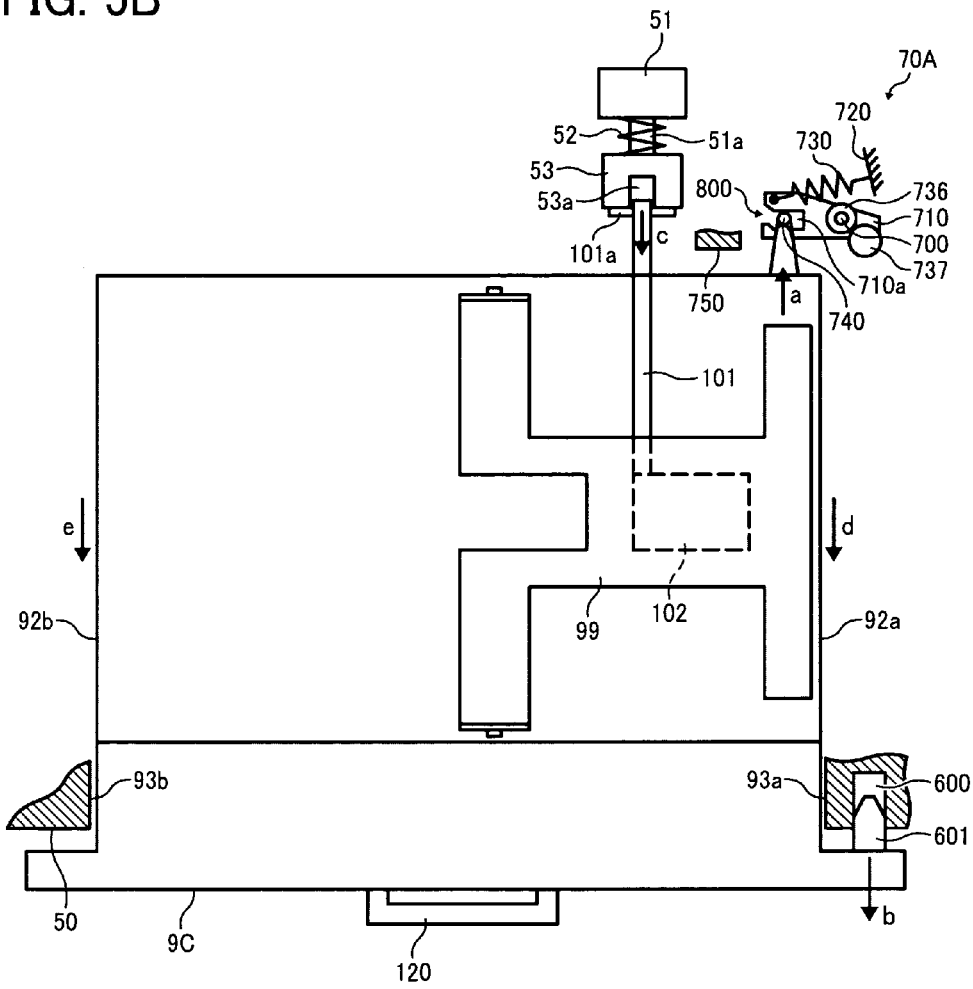
FIG. 5B is a top view illustrating a sheet tray including a pinion and a rotary damper as a velocity-dependent damper.
Figure 5C:
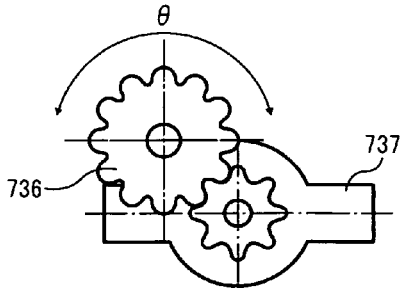
FIG. 5C is an enlarged view illustrating the pinion and the rotary damper shown in FIG. 5B.

Alternatively, the drawing arm 710 may be supported by the fixed shaft 700 via a rotary damper as shown in FIGS. 5B and 5C.

Referring to FIGS. 5B and 5C, an attachment assist device 70A includes a pinion 736 and a rotary damper 737 as another configuration of the velocity-dependent damper 735 shown in FIG. 5A. The pinion 736 is disposed coaxial to the drawing arm 710 and engages a gear attached to the rotary shaft of the rotary damper 737 as shown in FIG. 5C, thus exerting damper effects on the drawing arm 710. Except the velocity-dependent damper the attachment assist device 70A has a similar configuration to that of the attachment assist device 70 shown in FIG. 5A.

It is to be noted that the attachment assist device 70 is not limited to the above-described configuration using a toggle mechanism, as long as the main unit and the sheet tray 9C can engage with each other.

Next, referring to FIGS. 6 through 9, descriptions are given below of the position of the engagement position 800 between the sheet tray 9C and the sheet feeder 50 or the position of the engagement pin 740 in two cases in which proportions of the resistive forces b, c, d, and e in the sum thereof are different. The proportions of the resistive forces b, c, d, and e are respectively 50%, 30%, 10%, and 10% in proportion pattern 1 and 72%, 0%, 14%, and 14% in proportion pattern 2, for example.

Figure 6:
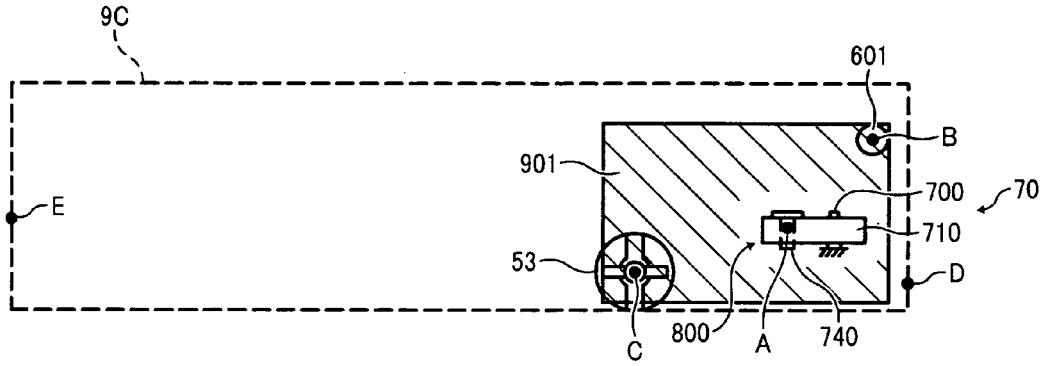
FIG. 6 is a projection in an insertion direction of the sheet tray in proportion pattern 1 of resistive forces.
Figure 7:
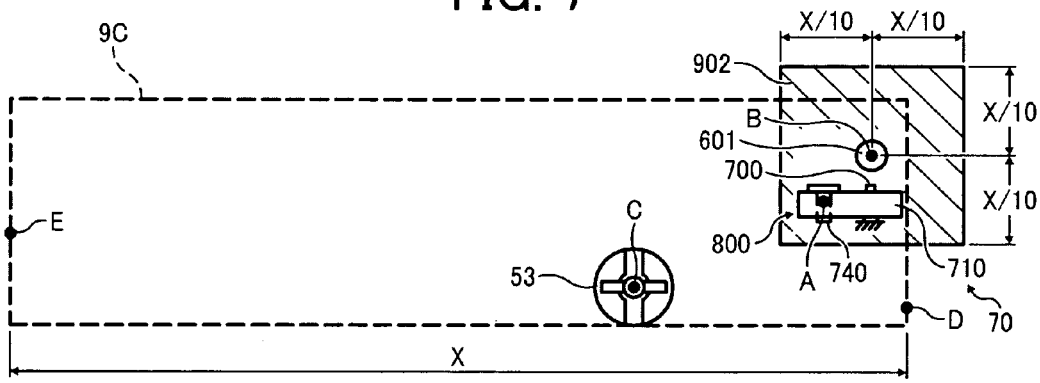
FIG. 7 is a projection in the insertion direction of the sheet tray in proportion pattern 2 of the resistive forces.
Figure 8:
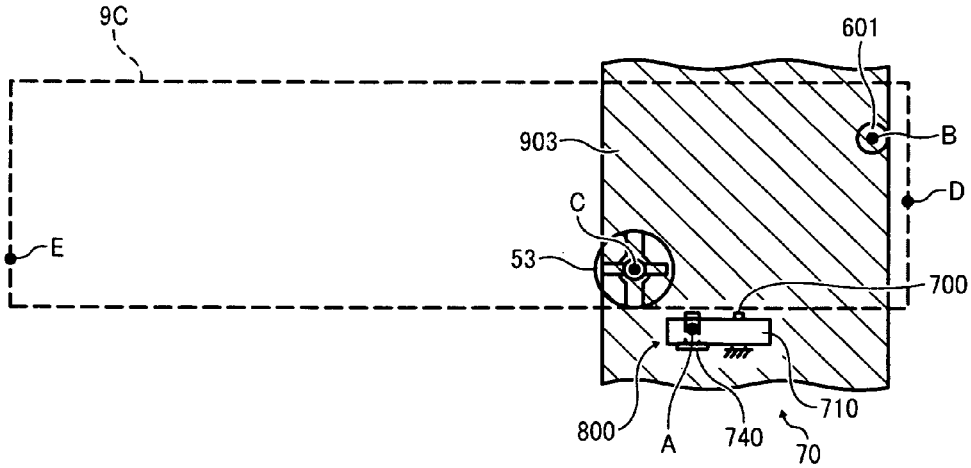
FIG. 8 is a projection in the insertion direction of the sheet tray in proportion pattern 1 of the resistive forces, and the engagement position is disposed at any given vertical position therein.

In FIGS. 6 through 8, reference character A represents a point of action on which the drawing force a of the attachment assist device 70 acts, that is, the position of the engagement position 800. FIGS. 6 and 7 illustrate the sheet tray 9C projected in the insertion direction in proportion patterns 1 and 2 of the resistive forces, respectively.

In proportion pattern 1, the resistive force b caused by the friction between the positioning hole 600 and the positioning boss 601 rivals the resistive force c, which is the reactive force of the spring 52 pressed by the coupling 53, and the sum of the resistive forces b and c accounts for 70% or greater of the total resistive force received by the sheet tray 9C.

In this case, it is preferable that the point of action A on which the drawing force a exerted by the attachment assist device 70 acts, that is, the position of the engagement position 800 or the engagement pin 740, be inside a hatched rectangular area 901 shown in FIG. 6. The rectangular area 901 shown in FIG. 6 is defined by points of action B and C of the resistive forces b and c, which together account for 70% or greater of the total resistive force.

When the engagement position 800 is disposed inside the rectangular area 901 as described above, the drawing force a is generated in the area defined by the points of action B and C of the two dominant resistive forces b and c in the total resistive force, which reduces the distance between a point of action of the resultant of the four resistive forces b, c, d, and e and the engagement position 800 to which the drawing force a is exerted. As a result, a moment to rotate the sheet tray 9C resulting from differences between the drawing force a and the resistive forces b, c, d, and e can be prevented.

It is to be noted that, to prevent the sheet tray 9C from receiving the resistive force c, the rotational position of the coupling 53 may be adjusted when the sheet tray 9C is pulled out so that the engagement projection 101*a* of the rotary shaft 101 provided in the sheet tray 9C can engage the engagement groove 53*a* of the coupling 53 when the sheet tray 9C is inserted into the sheet feeder 50. In this configuration, proportions of the resistive forces are classified as proportion pattern 2. In proportion pattern 2, because the resistive force b by itself accounts for more than 70% of the total resistive force, the rectangular area 901 defined by multiple resistive forces together accounting for a proportion greater than 70% is not formed.

Instead, in proportion pattern 2, as shown in FIG. 7, it is preferable that the engagement pin 740 be disposed at a position identical or similar to the point of action of the greatest resistive force among the four resistive forces b, c, d, and e (hereinafter "greatest resistive point") on the projection plane of the sheet tray 9C in the insertion direction. In the present embodiment, the position identical or similar to the greatest resistive point is considered to be inside an area 902 defined by lines at a distance of 10% of a maximum width X of the sheet tray 9C from the greatest resistive point in a horizontal direction as well as a vertical direction.

FIG. 8 illustrates the sheet tray 9C projected in the insertion direction in a configuration in which the proportions of the resistive forces are proportion pattern 1 and the engagement pin 740 engages the drawing arm 710 at a given position in the vertical direction.

Herein, the sheet tray 9C is typically longer in the horizontal direction, whereas shorter in the vertical direction, and thus a vertical positional deviation of the point of action A of the drawing force a relative to the points of action B, C, D, and E of the resistive forces b, c, d, and e is not likely to generate a vertical moment. Therefore, as shown in FIG. 8, the vertical position of the engagement position 800, that is, the engagement pin 740 on which the drawing force a acts, can be any given position. More specifically, a hatched area 903 shown in FIG. 8 is not defined in the vertical direction although defined in the horizontal direction by the points of action B and C of the resistive forces b and c, which together account for 70% or greater of the total resistive force, similarly to the rectangular area 901 shown in FIG. 6.

Figure 9:
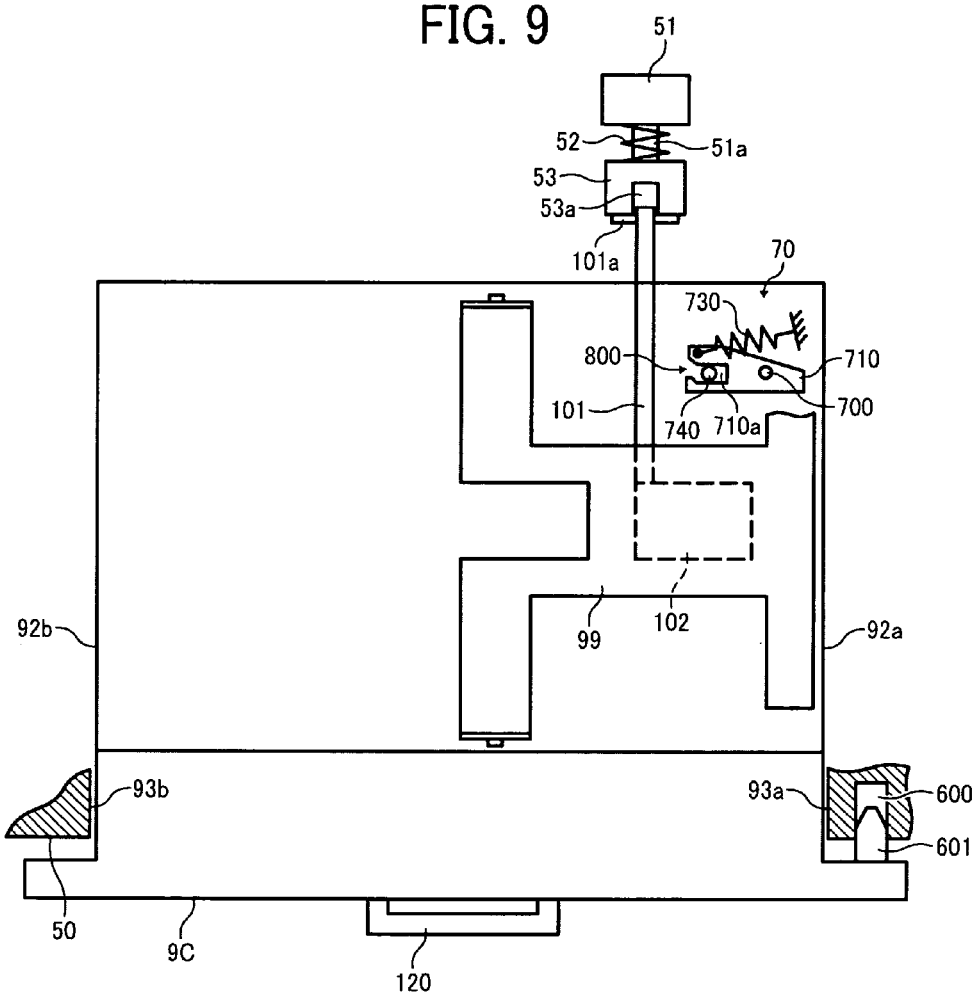
FIG. 9 is a top view illustrating the sheet tray shown in FIG. 8, attached to the sheet feeder.

In the above-described configuration in which the engagement position 800 of the attachment assist device 70 is disposed inside the area 903 having no defined borders in the vertical direction, that is, the engagement pin 740 engages the drawing arm 710 at any given vertical position on the projection plane in the insertion direction, the position of the attachment assist device 70 is not limited to the back of the sheet tray 9C but can be beneath the sheet tray 9C as shown in FIG. 9. That is, the engagement position 800 can be beneath the rectangular area 901 shown in FIG. 6. Therefore, the sheet feeder 50 has an increased flexibility in deciding the relative positions of the sheet tray 9C and the attachment assist device 70, thus attaining a relatively compact sheet feeder. It is to be noted that, in FIG. 9, the velocity-dependent damper 735 is omitted for simplicity.

Although the description above concerns the position of the engagement pin 740 when the attachment assist device 70 pulls the sheet tray 9C, embodiments according to the present invention are not limited thereto. For example, the components of each image forming unit 1 shown in FIG. 2 can be housed in a common unit casing as a removably insertable process cartridge and a similar attachment assist device may be used to assist attachment, in particular, insertion of the process cartridge into the printer 500. More specifically, a guide for insertion, a handle, and the like are provided in the process cartridge and, in replacement, the used process cartridge can be pulled out from the printer 500 serving as a main body to the front side after the exterior cover of the printer 500 is opened. Then, an unused process cartridge can be slid into the printer 500 from the front side to be attached to the printer 500. This configuration can facilitate insertion and removal of the process cartridge from the printer 500, and thus maintenance work can be easier. Further, damage to the process cartridge during insertion and removal thereof can be eliminated or reduced.

Additionally, each toner cartridge 40 is configured to be slidably attached to and removed from the attachment portion 400 in the present embodiment, and a similar attachment assist device may be used to pull the toner cartridge 40 into the attachment portion 400. In this case, handling of the toner cartridges 40 can be facilitated and damage thereto can be eliminated or reduced.

Figure 10:
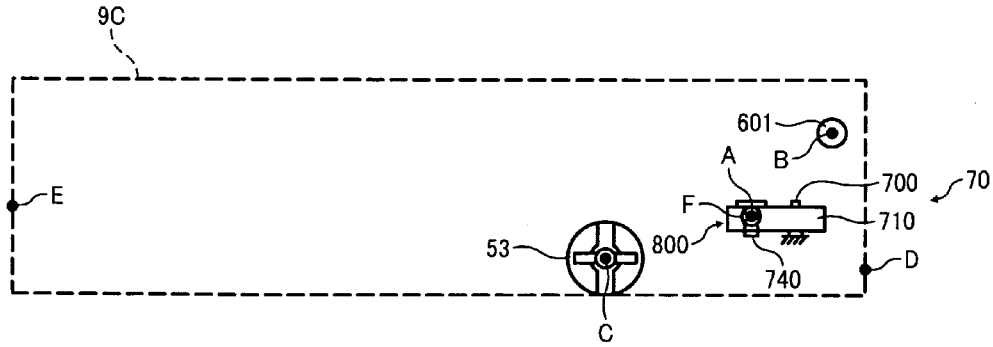
FIG. 10 is a projection in the insertion direction of the sheet tray, in which the engagement position is disposed at a position identical or similar to a point of action of a resultant of the respective resistive forces.

As described above, it is preferred to eliminate or reduce rotational moment exerted to the sheet tray 9C caused by imbalance between the drawing force for drawing the sheet tray 9C and the resistive forces b, c, d, and e and an increase in the resistivity resulting from such rotational moment. Therefore, as shown in FIG. 10, it is preferable that, on the projection plane of the sheet tray 9C in the insertion direction, the engagement position 800 be positioned at a position identical or similar to a point of action of the resultant F of the four resistive forces b, c, d, and e exerted to the sheet tray 9C while the sheet tray 9C moves from an drawing start position to an drawing completion position. In other words, rotational moment can be prevented by disposing the engagement position 800 on a line of action of the resultant of the four resistive forces b, c, d, and e.

Herein, the drawing start position of the sheet tray 9C means a position at which the engagement pin 740 of the sheet tray 9C engages the drawing arm 710 and thus the attachment assist device 70 starts drawing the sheet tray 9C. The drawing completion position means a position at which drawing of the sheet tray 9C ends and thus the sheet tray 9C is fully attached the predetermined position in the back portion of the sheet feeder 50.

It is to be noted that, although FIG. 6 illustrates a preferable position of the engagement position 800 in a case in which the sum of the resistive forces b and c accounts for 70% or greater of the total resistive force, the threshold is not limited to 70% but may be adjusted depending on the number of positions where a resistive force is generated, the strength of each resistive force, distribution of the resistive forces, or the like. In other words, the engagement position 800 is preferably disposed inside the rectangular area 901 defined by the points of action B and C of the two greater resistive forces b and c among the multiple resistive forces b, c, d, and e serving as opposing corners.

Similarly, although FIG. 7 illustrates a preferable position of the engagement position 800 in the case in which only a single greatest resistive force b accounts for more than 70% of the total resistive force, the threshold is not limited to 70% but may be adjusted depending on the number of positions where a resistive force is generated, the strength of each resistive force, distribution of the resistive forces, or the like. In other words, the engagement position 800 is preferably disposed at the position identical or similar to the point of action B of the greatest resistive forces b among the multiple resistive forces b, c, d, and e. Further, although FIG. 7 illustrates the area 902 defined by the lines at a distance of 10% of the maximum width X of the sheet tray 9C from the greatest resistive point in the horizontal direction as well as the vertical direction as an example of the position identical or similar to the greatest resistive point, the threshold is not limited to 10%.

It is to be noted that, in this specification, the points of action B, C, D, and E of the resistive forces b, c, d, and e are not defined in three dimensions but are two-dimensional positions on the projection plane in the insertion direction of the sheet tray 9C.

As described above, in the attachment assist device according to the present embodiment, the engagement position 800 is preferably disposed, on the projection plane of the sheet tray 9C in the insertion direction, inside the rectangular area 901 (shown in FIG. 6) whose opposing corners are the points of action B and C of the two resistive forces selected from the multiple resistive forces b, c, d, and e acting on the sheet tray 9C while the sheet tray 9C moves from the drawing start position to the drawing completion position.

With this configuration, the sheet tray 9C can be pulled with the engagement pin 740 engaged with the drawing arm 710 inside the rectangular area 901, which can prevent or inhibit generation of the moment resulting from the positional difference between the point of action of the drawing force a and those of the resistive forces b, c, d, and e on the projection plane of the sheet tray 9C in the insertion direction, and thus the sheet tray 9C can be inserted into the sheet feeder 50 reliably and set in position properly. Consequently, users can insert the sheet tray 9C into the sheet feeder 50 with reduced force.

Additionally, because the sheet tray 9C can be prevented from tilting or being caught in the sheet feeder 50 with the moment prevented or reduced, the user does not need to insert the sheet tray 9C mightily into the sheet feeder 50. Moreover, because the sheet tray 9C can be inserted into the sheet feeder 50 slowly and smoothly, impact to the sheet feeder 50 and the sheet tray 9C in the insertion of the sheet tray 9C can be reduced, thus eliminating or reducing misalignment of sheets contained in the sheet tray 9C as well as damage to the sheet tray 9C. Damage to corners of sheets such as curled corners can be prevented or reduced.

As described above, in the attachment assist device according to the present embodiment, the engagement position 800 is disposed, on the projection plane of the sheet tray 9C in the insertion direction, at the position identical or similar to the point of action of the resultant F of the multiple resistive forces b, c, d, and e acting on the sheet tray 9C while the sheet tray 9C moves from the drawing start position to the drawing completion position.

Thus, the sheet tray 9C can be pulled in the sheet feeder 50 with the engagement pin 740 engaged with the drawing arm 710 at the position identical or similar to of resultant F of the multiple resistive forces b, c, d, and e. This configuration can prevent or inhibit generation of the moment resulting from the positional difference between the point of action of the drawing force a and those of the resistive forces b, c, d, and e on the projection plane of the sheet tray 9C in the insertion direction. Accordingly, although the sheet tray 9C is pulled against the resistive forces b, c, d, and e as well as attenuation of the movement velocity of the sheet tray 9C by the damper 735 from the sheet feeder 50, the force necessary to pull the sheet tray 9C into the main body can be reduced, which can reduce the force required to pull out the sheet tray 9C from the sheet feeder 50 as well.

As described above, in the attachment assist device according to the present embodiment, the engagement position 800 is disposed, on the projection plane of the sheet tray 9C in the insertion direction, at the position identical or similar to the point of action B of the greatest force b among the multiple resistive forces b, c, d, and e acting on the sheet tray 9C while the sheet tray 9C moves from the drawing start position to the drawing completion position.

With this configuration, the sheet tray 9C can be pulled into the sheet feeder 50 with the engagement pin 740 engaged with the drawing arm 710 at the position identical or similar to the greatest resistive force b among the multiple resistive forces b, c, d, and e. This configuration can prevent or reduce the moment resulting from the positional difference between the point of action of the drawing force a and those of the resistive forces b, c, d, and e on the projection plane of the sheet tray 9C in the insertion direction, and thus the sheet tray 9C can be inserted into the sheet feeder 50 reliably and set in position properly.

Additionally, the attachment assist device according to the present embodiment includes the toggle spring 730, serving as the elastic member to generate drawing force, and the velocity-dependent damper 735 that decelerates the velocity with which the sheet tray 9C is pulled to the drawing completion position.

With this configuration, the sheet tray 9C can be inserted into the sheet feeder 50 slowly and smoothly, and impact to the sheet tray 9C or the sheet feeder 50 can be reduced. This configuration enables good alignment of the sheet tray 9C relative to the sheet feeder 50 in the insertion direction, eliminating or reducing misalignment of sheets, jamming of sheets, and curl of the sheets fed by the feed roller 10C from the sheet tray 9C.

Numerous additional modifications and variations are possible in light of the above teachings. It is therefore to be understood that, within the scope of the appended claims, the disclosure of this patent specification may be practiced otherwise than as specifically described herein.

What is claimed is:

1. An attachment assist device to assist attachment of a retractable unit to a main body, the attachment assist device comprising:

an engagement member provided in the retractable unit;

a catch portion provided in the main body, to engage the engagement member when the retractable unit is set at a start position from which the retractable unit is drawn in an attachment direction into the main body against multiple resistive forces acting on the retractable unit while the retractable unit moves from the start position to a completion position, guide rails provided in the main body, to guide movement of the retractable unit;

the catch portion engaging the engagement member at an engagement position disposed inside a rectangular area defined by two opposing corners respectively positioned at points of action of two of the multiple resistive forces acting on the retractable unit, except the resistive forces acting on the guide rails, on a projection plane on which the retractable unit is projected in the attachment direction;

the drawing unit drawing the retractable unit to the drawing completion position in the main body when the engagement member engages the catch portion, a pivotable member to engage the engagement member, which enables the catch portion to rotate, the catch portion being formed in an end portion of the pivotable member; and an elastic member configured to be biased to cause the pivotable member to pivot in a direction in which the retractable unit is drawn into the main body when the catch portion engages the engagement member, the elastic member having a first end fixed to the main body and a second end opposite the first end, the second end fixed to the pivotable member.

2. The attachment assist device according to claim 1, wherein the two opposing corners of the rectangular area inside, which the engagement position is disposed, are respectively disposed at points of action of two greater resistive forces among the multiple resistive forces acting on the retractable unit while the retractable unit moves from the start position to the completion position, the two greater resistive forces together accounting for 70% or greater of the multiple resistive forces in total.

3. The attachment assist device according to claim 1, wherein the engagement position where the engagement member engages the catch portion is proximate to a point of action of a resultant of the multiple resistive forces acting on the retractable unit while the retractable unit moves from the start position to the completion position.

4. The attachment assist device according to claim 1, wherein the engagement position where the engagement member engages the catch portion is disposed substantially identical to a greatest resistive force among the multiple resistive forces acting on the retractable unit while the retractable unit moves from the start position to the completion position.

5. The attachment assist device according to claim 1, further comprising a velocity-dependent damper to decelerate a velocity with which the retractable unit is drawn to the completion position in the main body.

6. The attachment assist device according to claim 1, wherein the retractable unit is a sheet tray for containing multiple sheets of recording media, and the main body is an image forming apparatus to form images on the sheet sent from the sheet tray.

7. The attachment assist device according to claim 1, wherein the retractable unit is a process cartridge in which multiple image forming components are united, and the main body is an image forming apparatus.

8. The attachment assist device according to claim 1, wherein the retractable unit is a toner cartridge for containing toner, and the main body is an image forming apparatus to form images on sheets of recording media using the toner supplied from the toner cartridge.

9. The attachment assist device according to claim 1, incorporated in a sheet feeder.

10. An attachment assist device to assist attachment of a retractable unit extending horizontally to a main body, the attachment assist device comprising:

an engagement member provided in the retractable unit;

a catch portion provided in the main body, to engage the engagement member when the retractable unit is set at a start position from which the retractable unit is drawn in an attachment direction into the main body against multiple resistive forces acting on the retractable unit while the retractable unit moves from the start position to a completion position, guide rails provided in the main body, to guide movement of the retractable unit;

the catch portion engaging the engagement member at an engagement position disposed beneath a rectangular area defined by two opposing corners respectively positioned at points of action of two of the multiple resistive forces acting on the retractable unit, except the resistive forces acting on the guide rails, on a projection plane on which the retractable unit is projected in the attachment direction; and the drawing unit drawing the retractable unit to the drawing completion position in the main body when the engagement member engages the catch portion, a pivotable member to engage the engagement member, which enables the catch portion to rotate, the catch portion being formed in an end portion of the pivotable member; and an elastic member configured to be biased to cause the pivotable member to pivot in a direction in which the retractable unit is drawn into the main body when the catch portion engages the engagement member, the elastic member having a first end fixed to the main body and a second end opposite the first end, the second end fixed to the pivotable member.

11. The attachment assist device according to claim 10, wherein the two opposing corners of the rectangular area below, which the engagement position is disposed, are respectively disposed at points of action of two greater resistive forces among the multiple resistive forces acting on the retractable unit while the retractable unit moves from the start position to the completion position, the two greater resistive forces together accounting for 70% or greater of the multiple resistive forces in total.

12. The attachment assist device according to claim 10, wherein a horizontal position of the engagement position where the engagement member engages the catch portion is close to a point of action of a resultant of the multiple resistive forces acting on the retractable unit while the retractable unit moves from the start position to the completion position.

13. The attachment assist device according to claim 10, wherein a horizontal position of the engagement position where the engagement member engages the catch portion is substantially identical to a point of action of a greatest resistive force among the multiple resistive forces acting on the retractable unit while the retractable unit moves from the start position to the completion position.

14. The attachment assist device according to claim 10, further comprising a velocity-dependent damper to decelerate a velocity with which the retractable unit is drawn to the completion position in the main body.

15. An image forming apparatus comprising:

an image forming unit to form images on sheets of recording media;

a retractable unit; and an attachment assist device to assist attachment of the retractable unit to a main body of the image forming apparatus, the attachment assist device including:

an engagement member provided in the retractable unit;

a catch portion provided in the main body, to engage the engagement member when the retractable unit is set at a start position from which the retractable unit is drawn in an attachment direction into the main body against multiple resistive forces acting on the retractable unit while the retractable unit moves from the start position to a completion position, guide rails provided in the main body, to guide movement of the retractable unit;

the catch portion engaging the engagement member at an engagement position disposed inside a rectangular area defined by two opposing corners respectively positioned at points of action of two of the multiple resistive forces acting on the retractable unit, except the resistive forces acting on the guide rails, on a projection plane on which the retractable unit is projected in the attachment direction; the drawing unit drawing the retractable unit to the drawing completion position in the main body when the engagement member engages the catch portion;

a pivotable member to engage the engagement member, which enables the catch portion to rotate, the catch portion being formed in an end portion of the pivotable member; and an elastic member configured to be biased to cause the pivotable member to pivot in a direction in which the retractable unit is drawn into the main body when the catch portion engages the engagement member, the elastic member having a first end fixed to the main body and a second end opposite the first end, the second end fixed to the pivotable member.

* * * * *